United States Patent [19]

Hsi

[11] Patent Number: 4,618,166

[45] Date of Patent: Oct. 21, 1986

[54] NOTEBOOK CONSTRUCTION

[76] Inventor: Peter H. Y. Hsi, 615 Piikoi St., Suite 2001, Honolulu, Hi. 96814

[21] Appl. No.: 652,507

[22] Filed: Sep. 20, 1984

[51] Int. Cl.[4] ..... B42D 1/00; B42D 9/00

[52] U.S. Cl. ..... 281/15 R; 281/42

[58] Field of Search ..... 281/15 R, 27, 42, 46, 281/3 R, 2, 34; 270/32

[56] References Cited

U.S. PATENT DOCUMENTS

| | | | |
|---|---|---|---|
| 702,413 | 6/1902 | Dressel | 281/15 R |
| 1,308,461 | 7/1919 | Walraven | 281/34 |
| 1,787,276 | 12/1930 | Jones | 281/15 R |
| 3,143,998 | 8/1964 | Madden | 281/42 |
| 4,355,822 | 10/1982 | McHugh | 281/34 |

FOREIGN PATENT DOCUMENTS

| | | | |
|---|---|---|---|
| 252871 | 3/1967 | Austria | 281/15 R |
| 660285 | 5/1938 | Fed. Rep. of Germany | 281/27 |
| 640476 | 7/1928 | France | 281/15 R |
| 1220573 | 1/1971 | United Kingdom | 281/27 |

*Primary Examiner*—Paul A. Bell

*Assistant Examiner*—Paul M. Heyrana

*Attorney, Agent, or Firm*—Armstrong, Nikaido, Marmelstein & Kubovcik

[57] ABSTRACT

A notebook construction in which multiple blank pages of a small notebook are provided by folded sheets of paper eight times the nominal dimensions of the notebook pages. Selective unfolding of the folded pages provides larger pages for use where desired. Sheets of paper having an area eight times the area of the folded pages are stacked and sewn together along one-half of a center fold. The other half of the center fold is cut so that each half of the sheet may be folded twice to the completely folded page size, and the sheets are of different colors so that the two halves of a particular sheet may be selected and used. The stitching utilizes threads of different colors, and the threads extend beyond the stitching by a distance sufficient for the threads to act as a built-in bookmark. The stiffer cover of the notebook has rows of perforations spaced inwardly from its edges to facilitate removal of edge portions so that the cover can fit into a pocket or pockets in a protective and/or decorative outer cover.

7 Claims, 4 Drawing Figures

NOTEBOOK CONSTRUCTION

BACKGROUND OF THE INVENTION

1. Field of the Invention

This invention relates to notebooks, and more particularly to notebooks having folded pages which can be unfolded to provide larger pages.

2. Description of the Prior Art (The term "prior art" as used herein, or in any statement by or on behalf of applicant, means only that any document or thing referred to as prior art bears, directly or inferentially, a date which is earlier than the effective filing date thereof.)

When using a small notebook, it often becomes desirable to have a page or pages of larger area than normal single pages in order to be able to make sketches and drawings on a relatively large scale without having to break up the sketch or drawing into smaller sections fitting the pages of the notebook. One way to accomplish this is to utilize a larger page and fold it up so it will fit within the confines of the covers of the notebook. None of the prior art devices with which I am familiar are in the form of a notebook having a plurality of blank pages usable in the normal manner but in which each of the pages may be unfolded to provide a page of larger area when desired.

It is believed that the patents listed below contain information which is or might be considered to be material to the examination of this application.

| Patent No. | Inventor |
|---|---|
| 512,882 | F. S. Hillhouse |
| 1,161,580 | I. R. Allen |
| 1,408,417 | A. A. Soderberg |
| 2,190,438 | L. E. Vogt |
| 1,809,943 | P. Ockenden |
| 335,916 | D. W. Glass |
| 1,009,687 | H. W. Patton |

These patents are believed to be relevant to the present invention because they were adduced by a prior art search made by an independent searcher.

A copy of each of the above listed patents is supplied to the Patent and Trademark Office herewith.

No representation or admission is made that any of the above listed documents are part of the prior art, in any acceptation of that term, or that no more pertinent information exists.

SUMMARY OF THE INVENTION

The notebook construction of the present invention makes it possible to use a relatively small notebook in the conventional manner. A plurality of the pages of the notebook are provided by sheets of paper folded to fit within the covers of the notebook. In this configuration, the outer faces of the folded sheets are available to be written upon. When it is desired to have a larger surface area, the sheets are unfolded, and it becomes possible to write upon both sides of the sheet over its entire area.

As an example, where the notebook is desired to provide fully open sheets of standard $8\frac{1}{2}$ inches by 11 inches letter size, the folded up pages are approximately $2\frac{3}{4}$ inches by $4\frac{1}{4}$ inches. This makes a compact notebook which can easily be carried in a shirt pocket, while at the same time providing a page for sketches, etc. of full $8\frac{1}{2}$ inches by 11 inches letter size, usable on both sides of the page.

To accomplish such result, pairs of folded pages are provided by each $8\frac{1}{2}$ inches by 11 inches sheet of paper. These sheets of paper are folded in half so that the folded sheet is approximately $5\frac{1}{2}$ inches by $8\frac{1}{2}$ inches. A plurality of such sheets are unfolded and assembled in a uniform pile. The pile of sheets is then secured together, as by sewing, along one-half of the fold line. A cut is made along the other half of the fold line. This cut makes it possible to fold each of the $5\frac{1}{2}$ inches by $8\frac{1}{2}$ inches half-sections of the sheet independently of each other. These sections are then folded in half to provide a folded page $4\frac{1}{4}$ inches by $5\frac{1}{2}$ inches, and this page is then folded in half again to the desired $2\frac{3}{4}$ inch by $4\frac{1}{4}$ inch size. Thus, the pages used may be the nominal $2\frac{3}{4}$ inches by $4\frac{1}{4}$ inches folded size, or may be unfolded once to provide twice the area, or unfolded twice to provide four times the nominal area. Two adjacent fully unfolded sheets may be used to provide eight times the nominal area.

It is contemplated that the separate sheets of paper used may be of different colors so the user can identify quickly which folded and/or unfolded pages are parts of the same large sheet of paper. Also, it is contemplated that the stitching holding the sheets of paper together may be of colored silken threads, and the silken threads may extend a desired distance beyond the actual stitching to provide a built-in bookmark. It is also contemplated that the sewn together pile of sheets of paper will be suitably attached, as by the described sewing, to a stiffer cover. The cover may be provided with perforations for removing portions of its edges so that one or both sides of the cover may be slipped into suitable pockets in a decorative outer cover.

It is therefore a principal object of the present invention to provide a relatively small size notebook in which each page is folded so it can be opened out to provide a page of larger area.

Another object of the present invention is to provide a notebook construction of the character described in which pairs of folded pages are provided by a sheet of paper which, when fully unfolded, is eight times the area of each folded page.

A further object of the present invention is to provide a notebook construction of the character described in which both members of each pair of folded pages may be identified as forming part of a single sheet of paper so that sketches, etc. may be made on a single sheet up to eight times the size possible when the sheets are fully folded.

A still further object of the present invention is to provide a notebook construction of the character described in which the sheets of paper are sewn together with a plurality of colored threads, and the colored threads extend beyond the sewn portion to provide a bookmark.

Other objects and features of advantage will become apparent as the specification progresses and from the claims.

Figure 1:
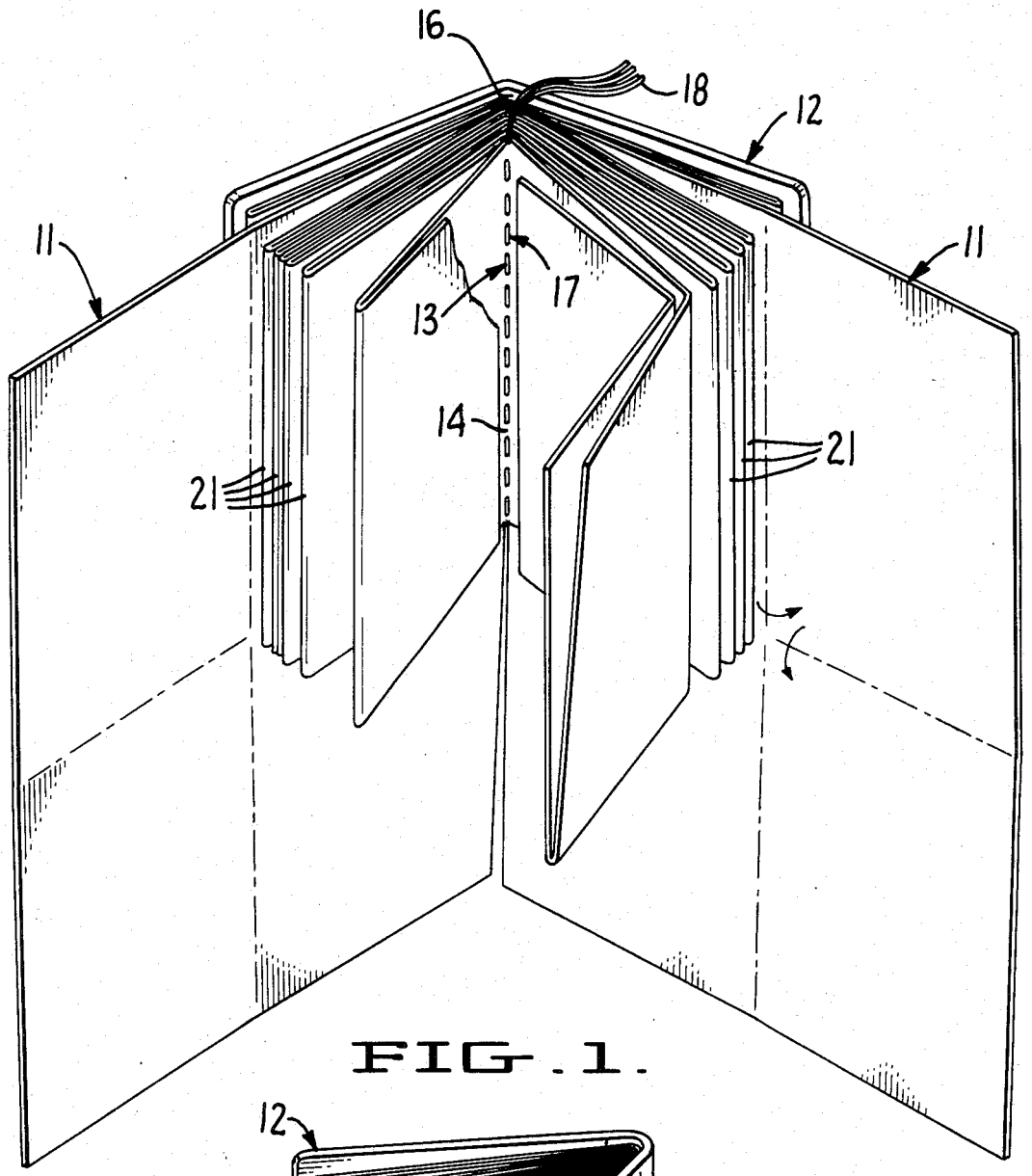
FIG. 1 is a perspective view of a notebook construction in accordance with the present invention, with the notebook partially opened and with some of the pages unfolded and broken away to illustrate details of construction.
Figure 2:
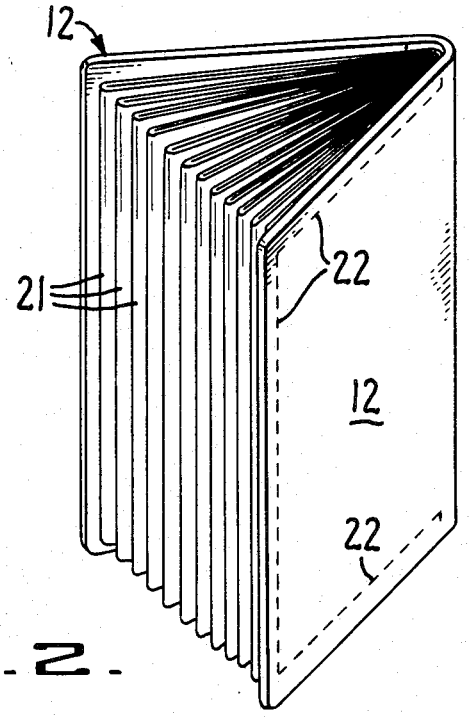
FIG. 2 is a perspective view of the notebook of FIG. 1 shown partially opened, but with all of its pages folded.

While only the preferred form of the invention is illustrated in the drawings, it will be apparent that various modifications could be made without departing from the ambit of the claims.

DESCRIPTION OF THE PREFERRED EMBODIMENTS

As may be seen in the accompanying drawings, the notebook construction of the present invention includes a plurality of rectangular sheets 11 of paper with each such sheet folded in eighths, a cover 12 folded in halves with each half approximating the length and width of each of the sheets 11 when such sheets are folded in eighths, the sheets 11 being stacked in unfolded condition, and means 13 securing the sheets 11 to each other and to the cover 12 along one-half of a central fold 14 of the sheets 11 and the corresponding fold 16 in the cover 12, the other half of the fold 14 in the sheets 11 being cut through whereby each of the sheets 11 is selectively foldable into eighths confined within the cover 12 and selectively unfoldable to provide pages in even multiples of the length and width of the fully folded sheets.

Figure 3:
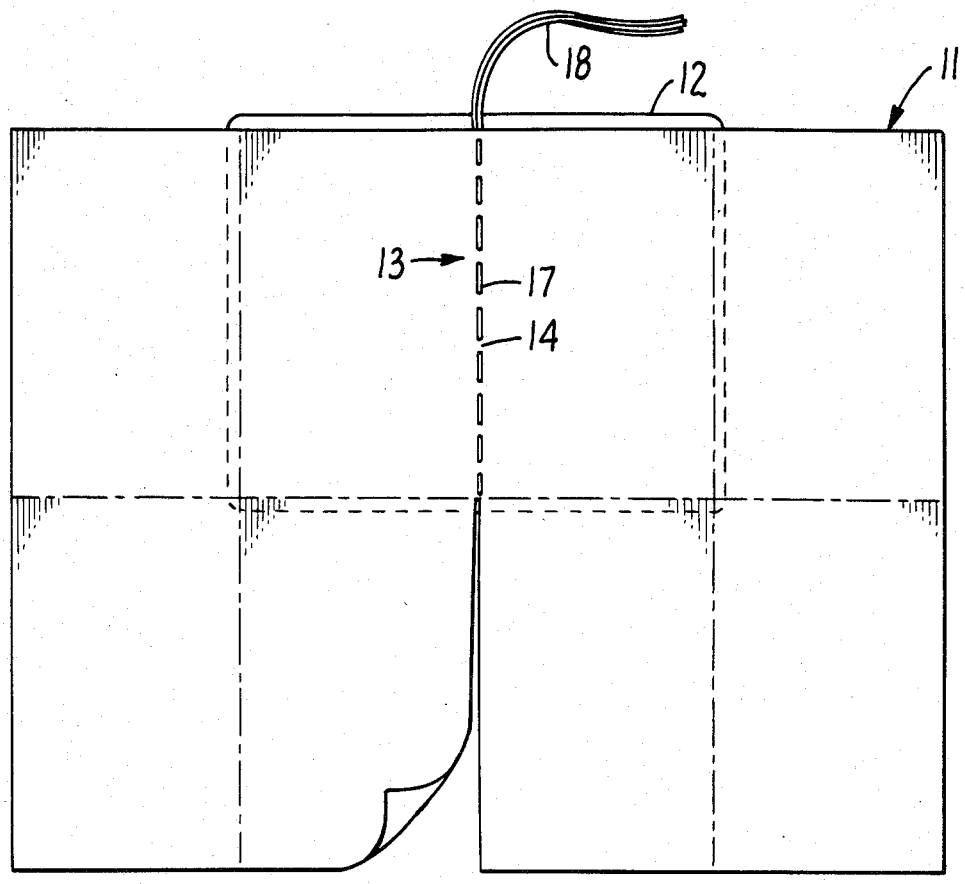
FIG. 3 is a plan view of the notebook of FIGS. 1 and 2, but with the center two pages unfolded completely to provide an area eight times the nominal area of the folded notebook pages.

As may be best seen in FIG. 3 of the drawings, the width of each of the sheets 11 is about twice the length of the halves of cover 12, and the length of each of the sheets 11 is about four times the width of the halves of the cover 12.

Figure 4:
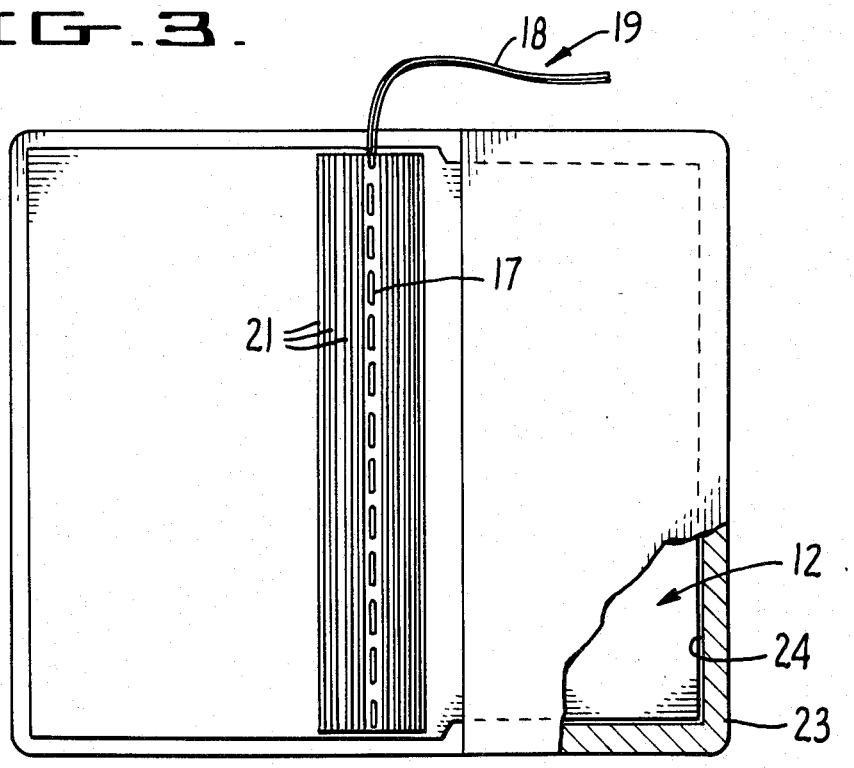
FIG. 4 is an enlarged plan view similar to that of FIG. 3, but showing all of the pages folded and in closed position, the cover of the notebook being opened out flat and shown engaged with a protective covering.

The means 13 may be of any suitable form, but I prefer to sew the sheets 11 together and to the cover 12 by providing continuous stitching 17 through the sheets 11 and cover 12 in the manner shown in FIGS. 1, 3 and 4 of the drawings. As here shown, the stitching 17 is in the form of multiple strands of threads 18, which preferably are of different colors, and the strands of threads 18 project beyond the stitching 17 to provide an integral bookmark 19.

The sheets 11 of paper also are preferably of different colors. Not only does this add to the decorative effect of the notebook construction, but also provides a practical advantage. With each sheet 11 of paper being used to form two of the fully folded pages 21 of the notebook, it becomes practical for the user to make a sketch, drawing or otherwise the full area of an individual sheet 11. This individual sheet may later be removed from the notebook as a unit.

The cover 12 is preferably of stiffer material than the sheets 11 of paper, and perforations 22 are formed in rows spaced inwardly from the ends and sides of the halves of the cover 12. An outer protective and/or decorative cover 23 is formed with pockets 24 for receiving one or both of the halves of the cover 12 after the portions thereof outside the perforations 22 are removed.

From the foregoing, it may be seen that the user of the notebook may use it simply as a small notebook utilizing the folded sections of the sheets 11 as pages 21. However, if it is desired to have a page with more area, any of the pages 21 may be unfolded once to provide twice the page area. If still more usable area is desired, that section of the sheet 11 may be unfolded once again to provide four times the normal area of the pages 21. If still more area is desired, another of the sections of sheet 11 may be unfolded once or twice. If it is desired that a sketch or the like occupy the maximum amount of available space, the user identifies a single sheet 11 by finding two pages 21 of the same color. Both of these pages are fully unfolded to the configuration shown in FIG. 3. This provides eight times the nominal size of the page 21, and both sides may be used. Later, the sheet upon which such sketch is made can be removed as a unit from the notebook.

In view of the foregoing, it will be seen that the notebook construction of the present invention provides a novel and versatile structure providing pages of different sizes as desired.

I claim:

1. A notebook comprising:

a plurality of rectangular superposed sheets of paper with each such sheet having a central fold and having additional symmetric folds such that each sheet is folded in eighths, thus dividing each sheet into eight generally equal sections;

a cover folded in halves with each half approximately the length and width of each of said sheets when folded in eighths, and means for securing said superposed sheets to each other and to said cover along one half of said central fold of said superposed sheets and the fold of said cover, the other half of said central fold of said sheets being cut through such that each of said sheets is selectively foldable into eighths to be confined within said cover and selectively unfoldable to provide pages in even multiples of the length and width of said sheets when fully folded.

2. A notebook as described in claim 1, and wherein the width of each of said sheets is about twice the length of each of said halves of said cover, and wherein the length of each of said sheets is about four times the width of said halves of said cover.

3. A notebook as described in claim 1, and wherein said sheets are secured to each other and to said cover by stitching stitched through said sheets and said cover.

4. A notebook as described in claim 3, and wherein said stitching is in the form of multiple strands of threads and said strands of thread project beyond said stitching to provide a bookmark.

5. A notebook as described in claim 4, and wherein said strands of threads are of different colors, and said sheets of paper are also of different colors.

6. A notebook as described in claim 1, and wherein said cover is of stiffer material than said sheets of paper, perforations are formed along at least one half of said cover and spaced inwardly from the ends and sides of said half of said cover, and an outer cover is formed with at least a pocket for receiving said half of said cover after the portions thereof outside said perforations are removed.

7. A notebook as described in claim 6, wherein said perforations are formed on both halves of said cover and said outer cover has two pockets, one each for receiving one of said cover halves when the portions outside of said perforations are removed.

* * * * *